US009518365B2

(12) United States Patent
Dixon

(10) Patent No.: US 9,518,365 B2
(45) Date of Patent: Dec. 13, 2016

(54) PAVEMENT MARKER

(71) Applicant: Byron Dixon, Arlington, VA (US)

(72) Inventor: Byron Dixon, Arlington, VA (US)

( * ) Notice: Subject to any disclaimer, the term of this patent is extended or adjusted under 35 U.S.C. 154(b) by 0 days.

(21) Appl. No.: 14/164,015

(22) Filed: Jan. 24, 2014

(65) Prior Publication Data

US 2015/0211196 A1 Jul. 30, 2015

(51) Int. Cl.
*E01F 9/00* (2016.01)
*E01F 9/07* (2006.01)

(52) U.S. Cl.
CPC ..... *E01F 9/076* (2013.01); *E01F 9/573* (2016.02)

(58) Field of Classification Search
CPC ..... E01F 9/06
USPC .... 404/9–12, 13–16; 116/63 R, 63 P; 49/35; 40/612
See application file for complete search history.

(56) References Cited

U.S. PATENT DOCUMENTS 1,736,326 A * 11/1929 Purcell ..... E01F 9/045 404/11
2,095,016 A * 10/1937 Waterbor ..... E01F 9/045 404/11
3,851,616 A * 12/1974 Brown ..... E01F 9/012 116/63 P
4,462,711 A * 7/1984 Garner ..... E01F 9/573 116/63 R
5,197,819 A * 3/1993 Hughes ..... 116/63 R
5,529,430 A * 6/1996 Jenkins ..... E01F 9/073 404/11
5,788,405 A * 8/1998 Beard ..... E01F 9/0124 116/63 P
6,955,496 B2 * 10/2005 Burchell ..... E01F 9/573 116/63 R
7,077,599 B1 * 7/2006 Hughes, Jr. ..... E01F 9/012 116/63 R
7,325,999 B1 * 2/2008 Schindler ..... E01F 9/0124 116/63 P
7,473,051 B2 * 1/2009 Audet ..... E01F 9/623 116/63 R
8,517,626 B2 * 8/2013 Dudley ..... E01F 9/06 404/12

* cited by examiner

*Primary Examiner* — Thomas B Will
*Assistant Examiner* — Katherine Chu
(74) *Attorney, Agent, or Firm* — Andrew C. Aitken

(57) ABSTRACT

A pavement marker is disclosed that includes a base member, two opposite resilient members and an upright member that includes a reflective surface. The resilient members, comprised of polyurethane receive opposite arms that extend from the upright members and allow for pivotal motion when force is applied to the reflective surface of the upright member.

4 Claims, 12 Drawing Sheets

PAVEMENT MARKER

The Applicant claims the benefit of U.S. Application No. 61/756,182 filed on Jan. 24, 2013. The present invention is directed at improved pavement markers. While there are numerous devices that have been developed to mark pavement used for road surfaces to increase the visibility of the edges of lanes on roadways especially for wet pavement, there remains a need for devices that are inexpensive, effective, easy to install and durable. In particular, there remains a need for pavement marker devices that are not easily damaged from snowplows, and that can easily be installed on roadways while at the same time can withstand extreme temperatures.

BRIEF DESCRIPTION OF THE INVENTION

The present invention is directed at pavement markers that allow vehicle drivers to better discern the edges of the lanes of roadways. Embodiments include a planar base member that has openings through which a pair of resilient support members is received. The resilient members are comprised of polyurethane and are adapted to receive a reflector member and hold the reflective member in an upright position. If a force is applied to the reflector member, it can pivot on an axis at a location near the bottom of the reflector member and be displaced so that it substantially parallel with the planar surface defined by the base member. When the force is removed, the reflector will quickly return to its upright position. In embodiments, the marker device is installed in a groove that has a floor that is below the driving surface of a roadway. Typically the grooves provided on roadway surfaces are oriented parallel with the lane of a roadway on which traffic travels. The base of the device is fastened to the floor of the groove. In a preferred embodiment the base member is attached to the road surface with an epoxy resin which functions as an adhesive. A series of passages are provided through the base member that serve to increase the surface area to which the epoxy can bond with base member and, when in a fluid state, allows the epoxy to flow through the passage and expand. When the epoxy hardens it therefore forms both a mechanical and chemical bond with the road surface. The passages also serve to decrease the weight of the base member and the amount of material that is needed to manufacture the base member base without materially sacrificing the strength of the base member.

In alternative contemplated embodiments, the device may be attached to the bottom surface of a groove using fasteners or combinations of adhesive and fasteners. In other embodiments, a reflector is provided on a base member and is maintained in place by resilient pad members positioned on either side of an upright member. When a force is exerted on the reflective surface the upright member pivots down toward the base member. When the force is removed, the resilient member causes the reflective member to return to the upright position.

DETAILED DESCRIPTION

Figure 1:
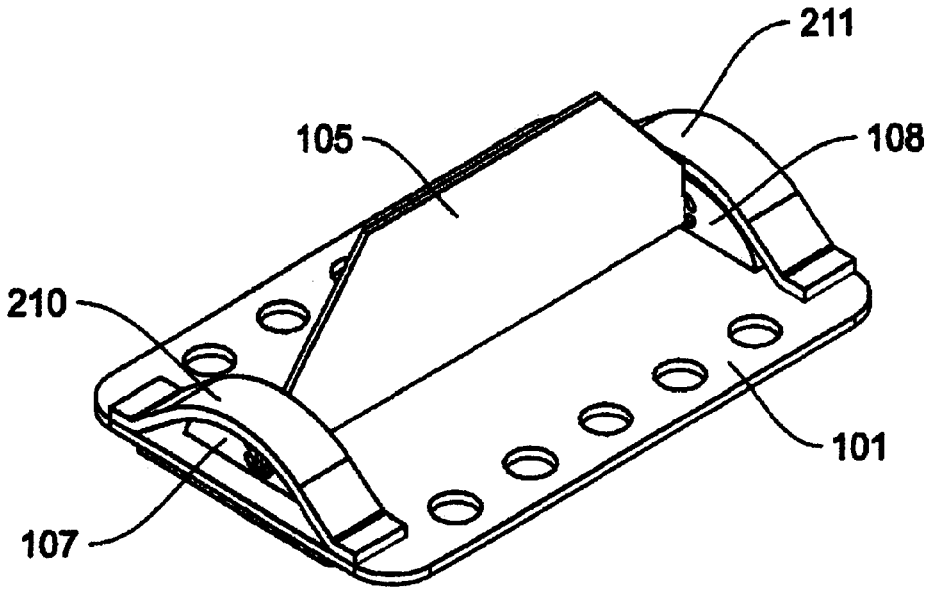
FIG. 1 is a perspective view of a first embodiment of the invention.

Now referring to FIG. 1 a first embodiment of a pavement marker according to the invention includes a base member 101, resilient support members 107 and 108 and upright reflective member 105. The resilient members 107 and 108 receive upright member 105. If a force is applied on the planar surface of the upright member 105 at a position above the location where the member is engage by the resilient members 107 and 108, the upright member 105 may be displaced, pivoting at the engagement location within the resilient members 107 and 108 wherein the top of the upright member 105 moves toward the base member 101.

Figure 2:
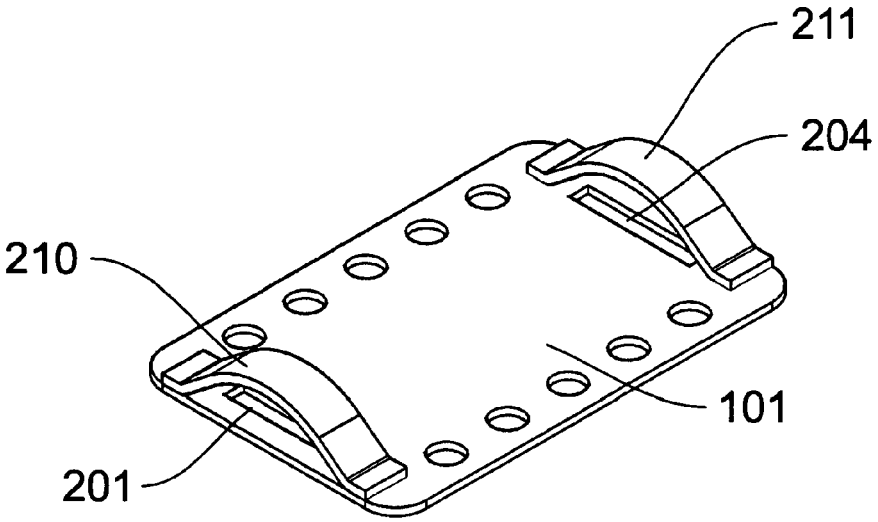
FIG. 2 is a perspective view of the based member of the invention depicted in FIG. 1.
Figure 3:
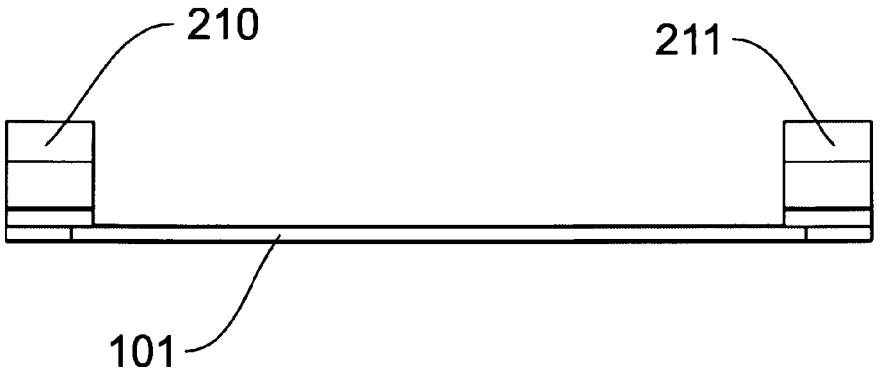
FIG. 3 is a front view in elevation of the base member of the invention depicted in FIG. 1.
Figure 4:
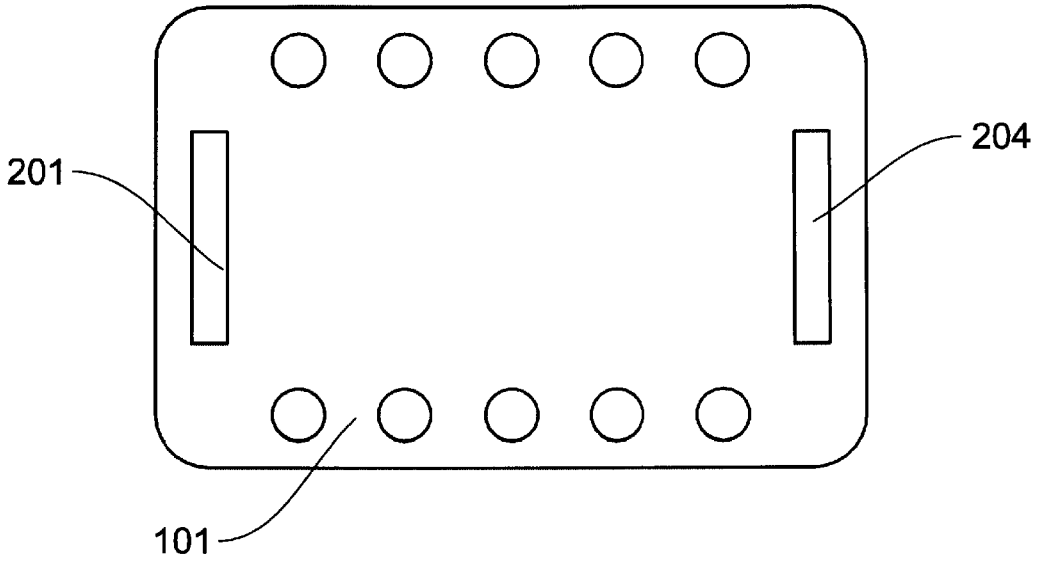
FIG. 4 is a bottom plan view of the based member of the invention depicted in FIG. 1.

Base member 101 of this embodiment is made from galvanized steel and has a thickness of 0.040 inches. The base member also includes guard elements 210 and 211 that protect the resilient members. As best seen in FIG. 2 on opposite ends of the base member members are slots 201 and 204 which are sized to receive resilient members. FIG. 3 depicts base member 101 in elevation that shows the guard members 210 and 211 that extend there from. In embodiments, the ends of the guard members are attached to the base member by welding. In other embodiments, fasteners such as rivets or screws or a chemical adhesive may be employed to secure the guard to the planar section of the base member. FIG. 4 depicts a bottom view of the base member 101 that shows the opposite slots 201 and 204 that are provide through the base member. The guard 210 is visible through slot 201.

Figure 7:
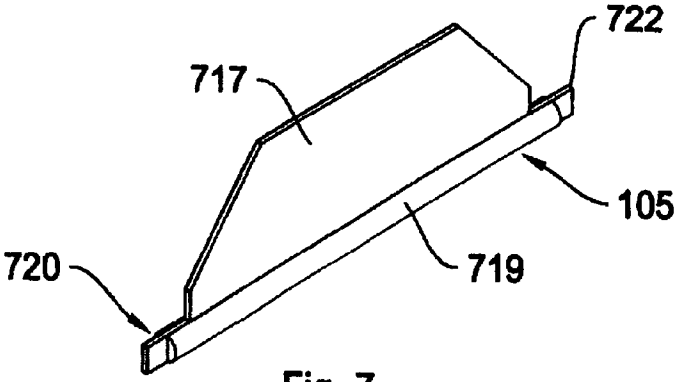
FIG. 7 is a perspective view of the reflector element that is can be used in either embodiment of the invention.
Figure 8:
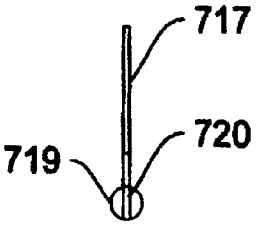
FIG. 8 is a side view of the reflector element.
Figure 9:
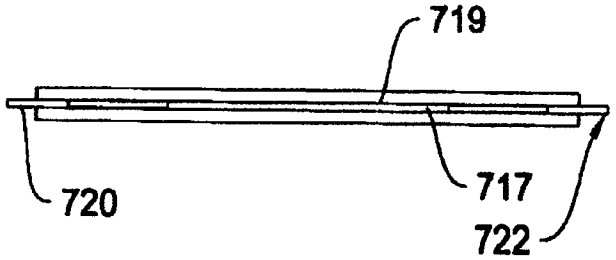
FIG. 9 is a top view of the reflector element.
Figure 10:
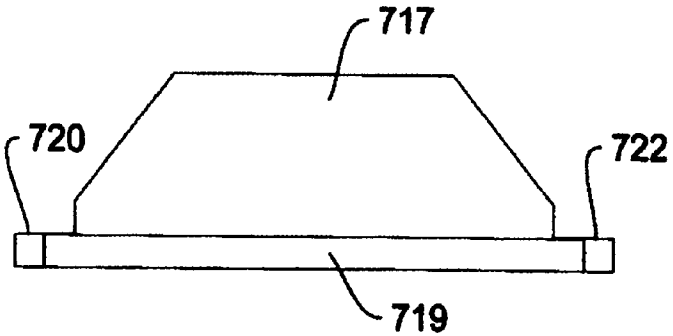
FIG. 10 is a front view in elevation of the reflector element

Now referring to FIG. 7, upright member105 has a trapezoid region 717 that receives a reflective surface. On opposite sides of the member are arms 720 and 721 which extend from a rod-shaped base section 719. While the arms 720 and 722 have a flat planar profile, as best seen in FIG. 8, an axial section through base section 720 is round. In embodiments, the upright member 105 is comprised of galvanized steel. The upright member and base member could be comprised of other materials including synthetic resins such as polyethylene, polypropylene and nylon. Region 717 of upright member 105 may be rendered reflective using a reflective coating, reflective tape or other reflective surface materials, such as synthetic resins. Thus, the reflective surface is created by the application of reflective tape, such as that marketed by the 3M company that reflects light. A variety of colors of made of reflective tape may be used depending on the particular application or roadway that is marked.

Figure 11:
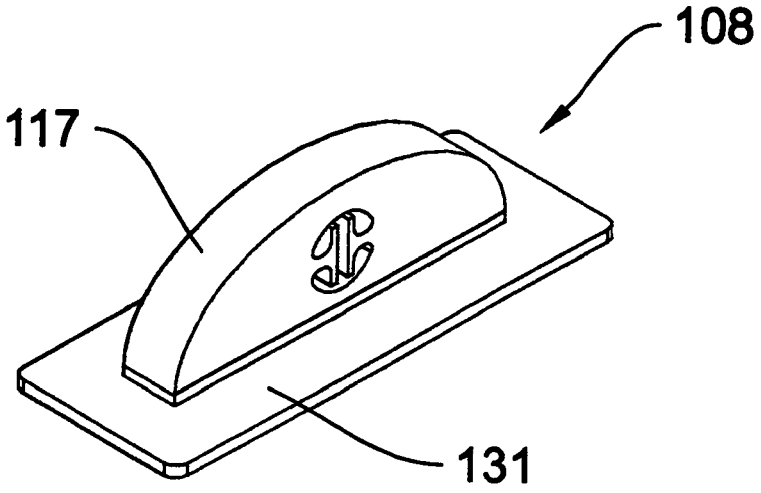
FIG. 11 is a perspective view of the resilient member according to an embodiment of the invention.
Figure 12:
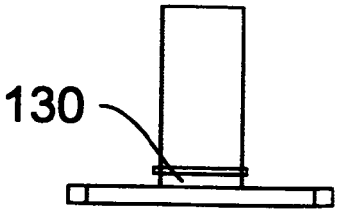
FIG. 12 is a side view in elevation of the resilient member depicted in FIG. 11.
Figure 13:
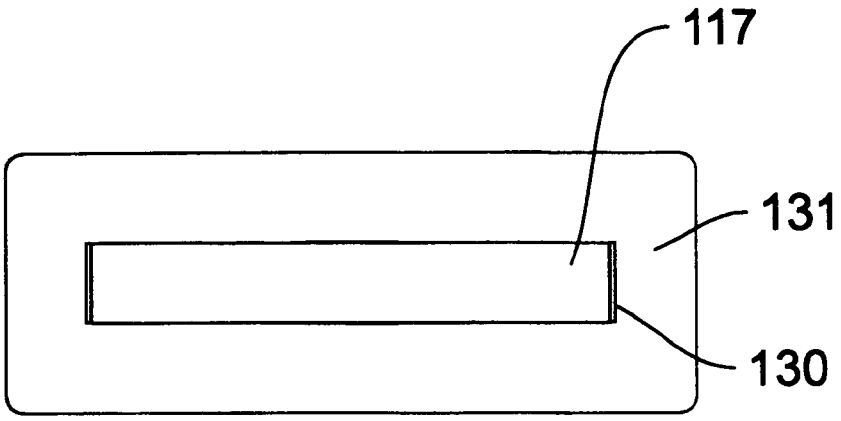
FIG. 13 is a top view of the resilient member of FIG. 11.

Referring now to FIG. 11 the resilient member 108 is generally in the shape of a half circle section 117 that extends from a flange section 131. Second flange element 130 serves to retain the resilient member securely on the base member plate at a location between flange 131 and 130. Provided though the resilient member 108 is passage 115 that receives an extension 720 or 722 that is integral to upright member 105. Passage 115 includes two opposite arms 120 and 126 that define a slot 115 into which the planar extension portion 720 of the upright member is received. The passage includes oval shaped openings such as passages 150 and 151 that facilitate the ability of the upright member 105 to pivot within resilient member 108.

Figure 14:
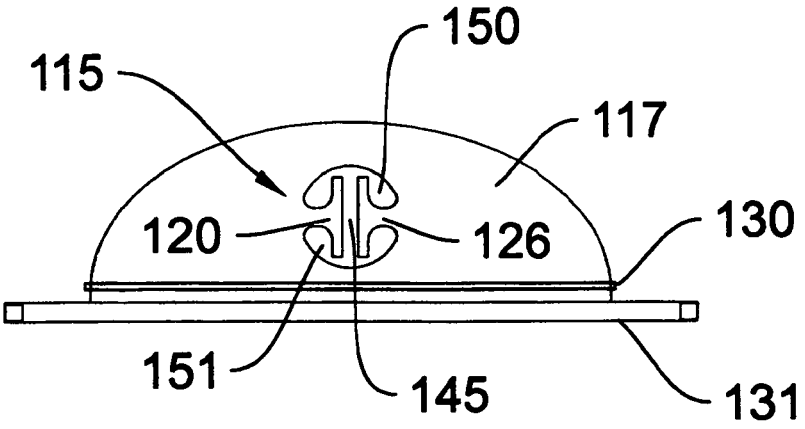
FIG. 14 is a side view in elevation of a resilient member of FIG. 11.

FIG. 14 depicts a side view in elevation of the resilient member 108 that depicts the passages 150 and 151 though the center of the structure. The extensions 120 and 126 that extend within the resilient member are generally "T shaped." It contemplated that other arrangements may also be used provide that they allow for pivotal rotation within the resilient member. In preferred embodiments, resilient member is made from polyurethane. It is contemplated that other materials could be used that have similar elasticity properties. While the preferred embodiment uses a synthetic resin, it is contemplated that other materials may be used that provide for similar resilient properties. On the preferred embodiment the resilient member 108 has a height of about ⅞ of an inch and a width of about 0.25 inches.

While the resilient member depicted in the embodiments herein has a half circle profile, it is contemplated that other shaped profile could be advantageously used including squares, triangles and rectangles. It is further contemplated that other opening designs could be employed to retain the planar and facilitate pivotal motion of the upper member within the device.

Figure 24:
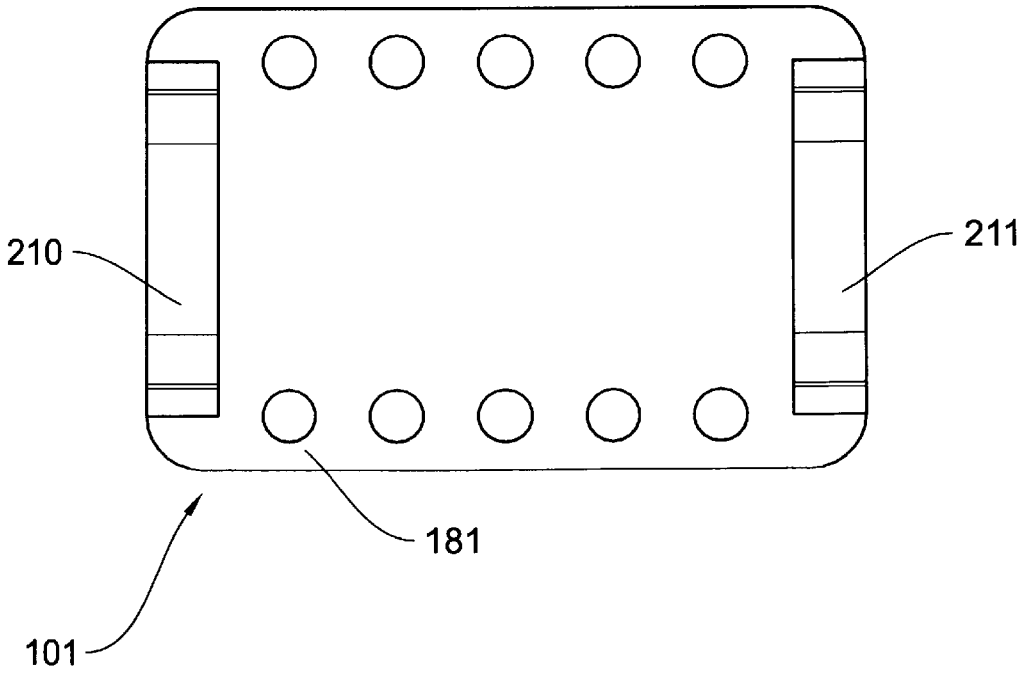
FIG. 24 is a top view of the base member depicted in FIG. 23.

Now referring to FIG. 24, a top plan view of the base member 101 is provided that includes an illustration of guard members 210 and 211 that protect the resilient members 108 and 107. A series of openings such has through-hole 181__ are provided on both sides of the device which result in a lighter yet strong part, and increase the surface area that the epoxy can engage the device, and they can receive mechanical fasteners such as nails, bolts etc.

Figure 6:
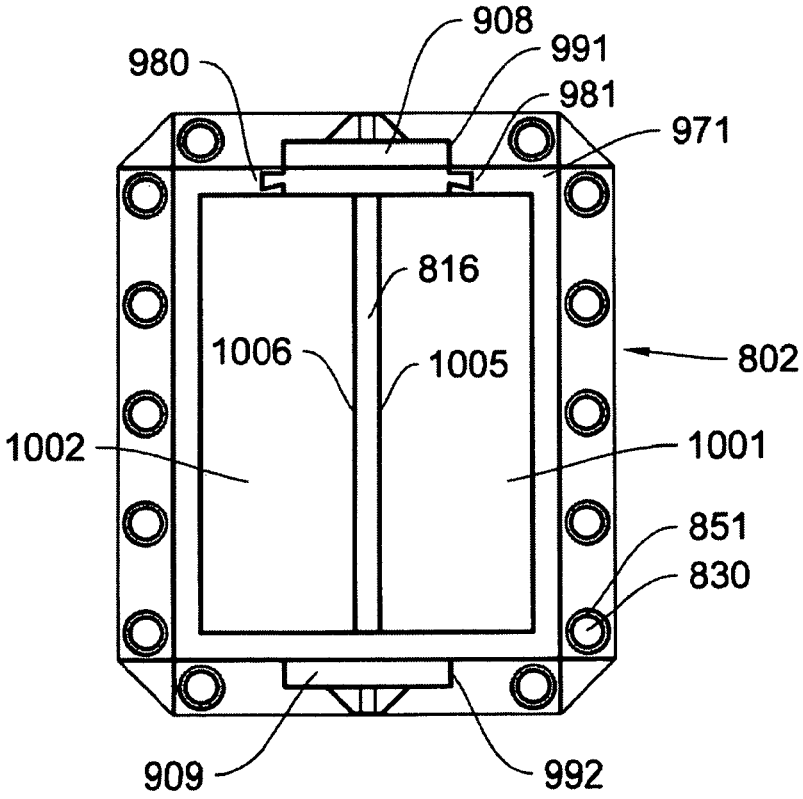
FIG. 6 is a top plan view of a second embodiment of the invention.
Figure 15:
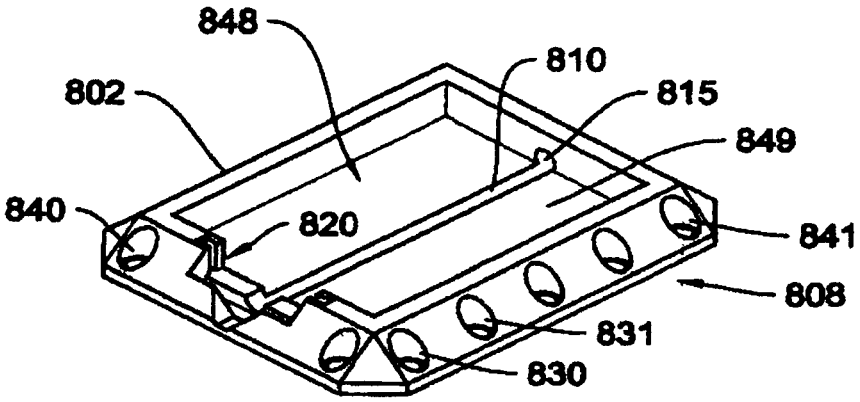
FIG. 15 is a perspective view of a base member of a second embodiment of the invention.
Figure 16:
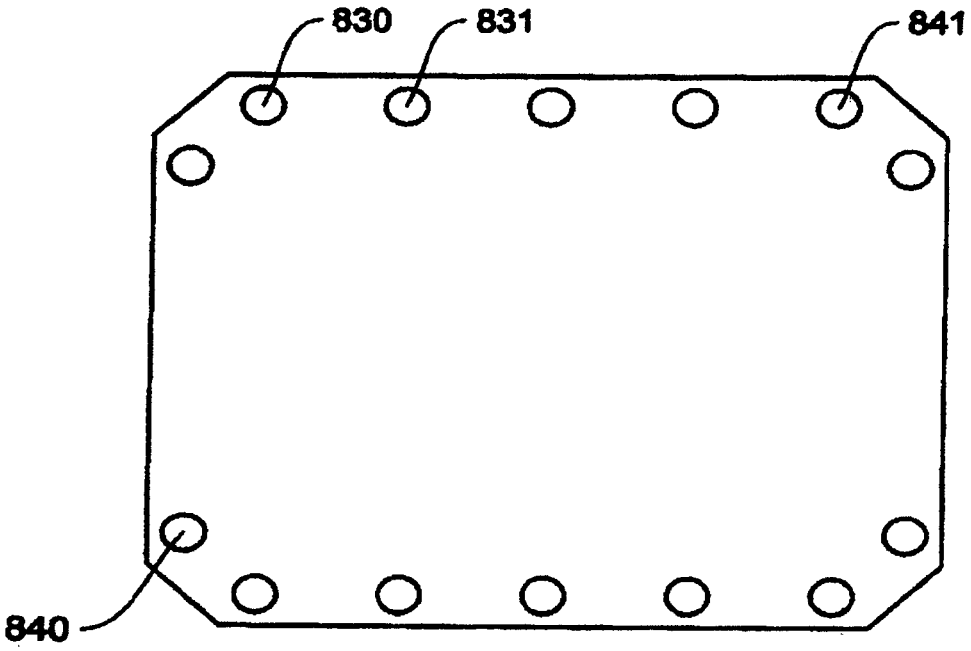
FIG. 16 is a bottom view of the base member of the embodiment depicted in FIG. 15.
Figure 17:
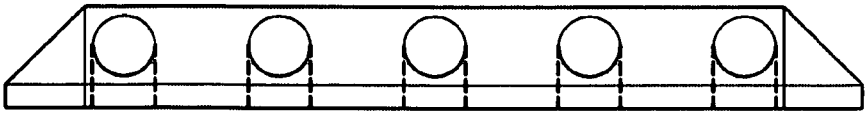
FIG. 17 is a front view in elevation of the base member of the second embodiment.
Figure 18:
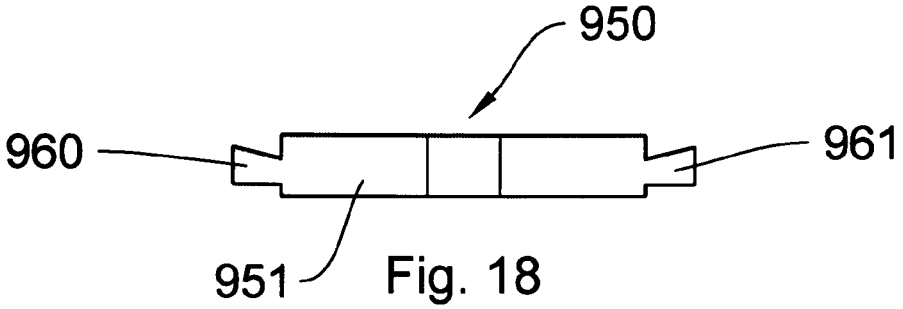
FIG. 18 is a top view of an insert locking member used in connection with a second embodiment of the invention.
Figure 19:
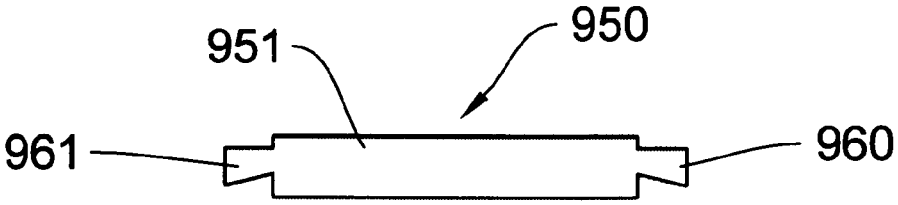
FIG. 19 a bottom view of an insert locking member used in connection with a second embodiment of the invention.
Figure 20:
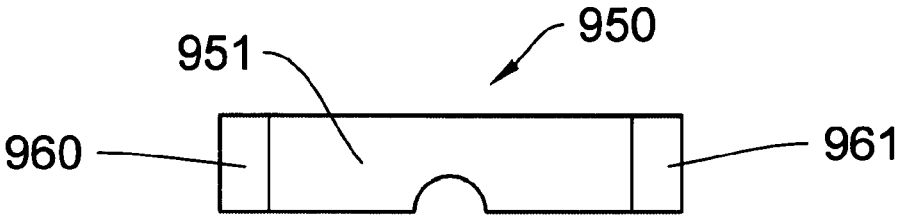
FIG. 20 is a side view in elevation of the insert depicted in FIG. 18.
Figure 21:
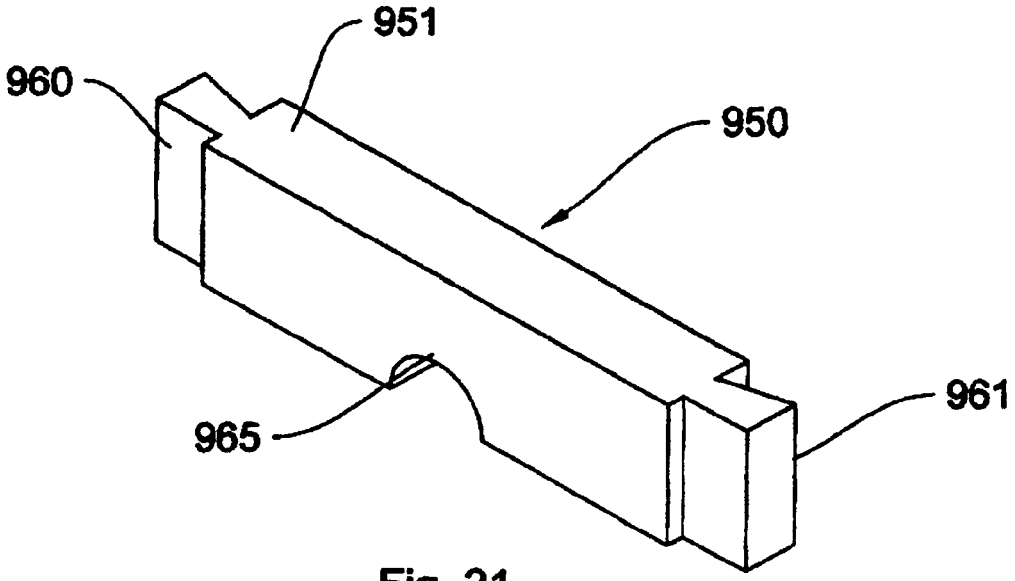
FIG. 21 is a perspective view of the insert depicted in FIG. 18.

Now referring to FIG. 15, an alternative embodiment of the invention is depicted. In this embodiment the pavement marker 808 includes base member 802 is provided with a transverse groove 810 that is sized to receive the base member 719 of upright member 105. The one end of the base member is inserted into seat 815 which allows the member to pivot within the groove and end seat. The opposite end of the base member is secured into position by a locking member (not shown) that is received in slot 820. A series of openings such as 830, 831, 840 and 841 are provided around the periphery of the base member that are used in connection with securing the base member to the pavement or other surface. The base member defines a central regions or cavities 848 and 849 that are designed to receive resilient member. The base member can be secured using an epoxy resin such as described above or with fasteners. As best seen in FIG. 6, the through holes such as hole are smaller than the opening that provide access to the hole on the top surface wherein the ledge area 851 can receive the epoxy as it flows through or the head of fasteners can engage ledge 851. As seen on FIG. 16, the bottom of the base member 802 is generally planar and, as illustrated therein, the holes 830, 831 841 and 840 extend through the base member.

Figure 22:
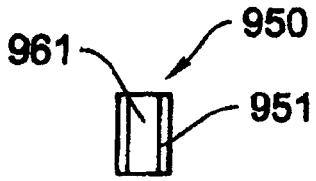
FIG. 22 is an end view of the insert depicted in FIG. 18.
Figure 23:
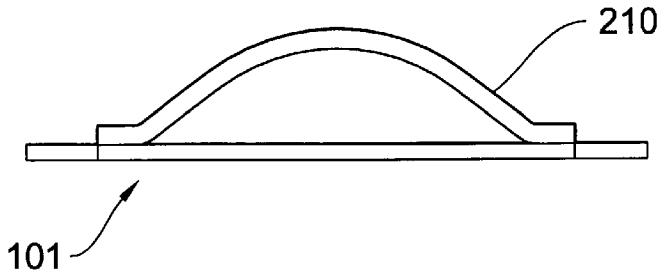
FIG. 23 is a side view in elevation of the base member of the first embodiment.

Locking member 950 that is received in slot 820 is depicted in FIGS. 18-22. Referring to FIG. 22, the locking member 950 includes opposite extensions 960 and 961. Provided on one side of the central section 951 is a semi-circular passage 965 that is designed to receive the base member 791 of upright member 105 and allow for limited rotation therein. Referring to FIG. 6, the extensions 960 and 961 are received in opposite slots 980 and 981 that are provided on sidewall 971 of the base member 802. The embodiment of FIG. 6 also includes the resilient members 908 and 909 located in slots 991 and 909 provided on opposite sides of the base member. Members 908 and 909 have the substantially the same structure as resilient member 108 as depicted in FIGS. 11-14. As best seen in FIG. 6, resilient pads 1001 and 1002 are received in cavities 848 and 849 and surfaces 1005 and 1006 of said pads 1001 and 1002 define a gap or slot 816 that allows access to groove 810 into which the base member 719 of upright member is received. The pads, which are rectangular have flat top and bottom surfaces and can be glued into the base member 808, can be held in place by frictional engagement or a combination of both. It is contemplated that the base member may comprise other shapes including circular, oval or other polygons. As such the pad members may also comprise different shapes, such as semicircular, provided there is an elongate slot to receive said upright member and maintain the member in an upright position. The upright member 105 can thereby pivot within the grove in response to a force that is applied to the reflector surface area 71 7 toward the base member. The upright member is maintained in an upright position by the opposite resilient pads 1002 and 1003. These resilient pads may be comprised of polyurethane or latex or other materials that have similar resilient characteristics such as silicone foam, or neoprene.

Figure 5:
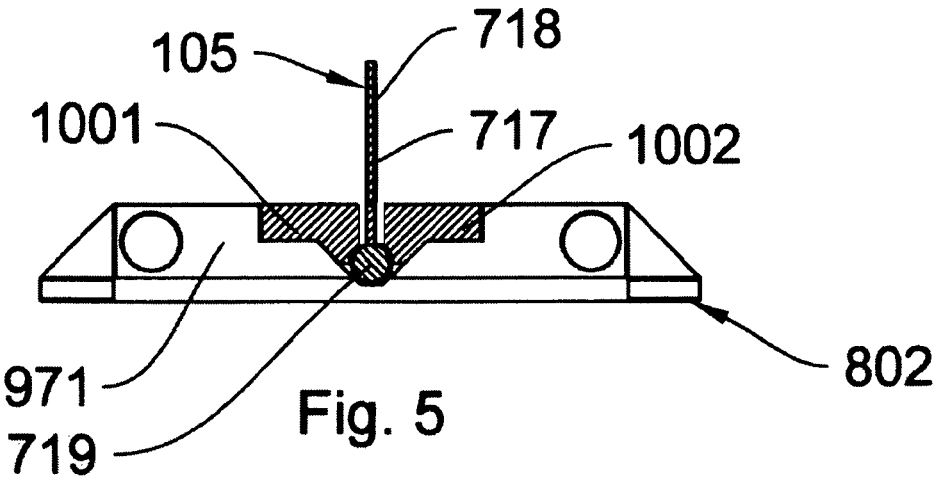
FIG. 5 is a side view in elevation of a base member of a second embodiment of the invention with the locking member removed and the upright member and resilient pad shown in section.

FIG. 5 depicts an end view of the base member 802 with the resilient member 1001 and 1002 in section with the upright member in a home and upright position. Section 717 of upright member 105 is positioned and maintained in an upright position within the gap between the two resilient pads 1001 and 1002 and pivots on base member 719. If a force is applied to the surface 718 it will displace the member into pad 1001. When the force is removed, the resilient member 1001 will cause the member to return to the upright position.

Figure 25:
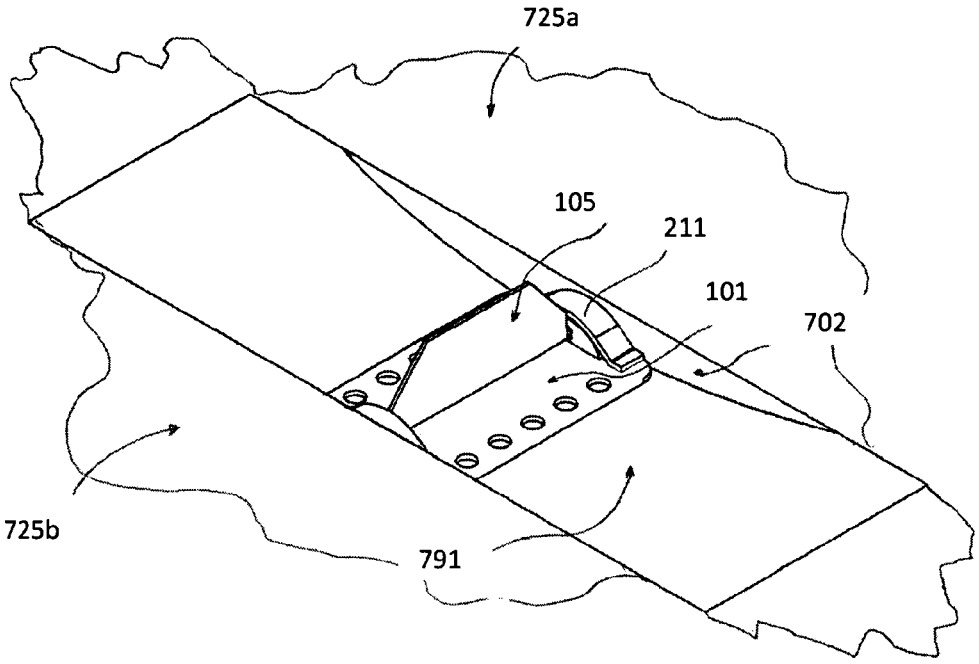
FIG. 25 depicts a pavement marker according to the invention within a groove provided within a paved surface.

As seen in FIG. 25, the first embodiment described is shown installed in a flat bottomed groove or trench 720 provided within a road driving surface 725*a* and 725*b*. The bottom surface of the groove 791 receives the base support member 101 of the device. The device may be secured within the groove by adhesives such as epoxy, fasteners or both. In preferred embodiments the groove should have a depth of ⅞ of inch.

Advantages of the invention include the upright orientation of the reflective surface minimizes the abrasion and allows the device to shed water and dirt because of the resilient motion. Moreover, the reflector element, if damaged or removed, may be easily replaced while the based member is secured to a road surface. The materials specified can perform up to in extreme temperatures up to –0 degrees F. and the device is not damaged from impacts with snowplows or tires.

It will be clear to one skilled in the art that the embodiments described above can be altered in many ways without departing from the scope of the invention. Accordingly, the scope of the invention should be determined by the following claims and their legal equivalents.

I claim:

1. A pavement marker comprising a base member, two opposite resilient members and an upright member, said base member comprising a substantially planar base section that extends under said upright member and adapted to receive and retain said resilient members, said resilient members spaced apart from one another and adapted to retain said upright member in an upright position and allow for limited pivotal rotation in response to a force applied to said upright member, and wherein said upright member comprises a reflective surface and wherein said base defines a transverse groove and said upright member further comprises a rod-shaped section and said groove is adapted to receive said rod shaped base section and allow for limited pivotal movement within said groove wherein said resilient members comprise resilient pad members, said resilient pad members received in said base member and oriented in a plane generally parallel with the said planar base section of said base member and said resilient pad members define a lateral slot into which said rod shaped base section of said upright member is received and where said resilient pads engage said upright members in response to a force that is applied to upright members and said resilient pads help support said upright member in upright position.

2. The pavement marker recited in claim 1 further comprising opposite additional resilient base members and said additional resilient base members further comprising a slot to receive arms of said upright member and provide for pivotal movement].

3. The pavement marker recited in claim 2 wherein said base member further comprises a circular seat [and a circular passage, wherein said passage is and said seat is comprised of a locking member having a semi-circular profile and the groove in said base member and said circular seat retains said rod section of said upright member and allows for pivotal motion.

4. The pavement marker recited in claim 2 wherein said reflective surface comprises reflective tape applied to said upright member.

* * * * *